United States Patent [19]

Dahl

[11] 4,441,269

[45] Apr. 10, 1984

[54] SIGN FRAME

[75] Inventor: Byron M. Dahl, Watertown, S. Dak.

[73] Assignee: Esco, Inc., Watertown, S. Dak.

[21] Appl. No.: 356,331

[22] Filed: Mar. 9, 1982

[51] Int. Cl.[3] ..... G09F 1/12

[52] U.S. Cl. ..... 40/156; 40/603; 40/617

[58] Field of Search ..... 40/603, 617, 156, 152, 40/13

[56] References Cited

U.S. PATENT DOCUMENTS

| | | | |
|---|---|---|---|
| 979,221 | 12/1910 | Tarr | 40/603 |
| 1,408,079 | 2/1922 | Davis et al. | 40/603 |
| 4,185,408 | 1/1980 | Tracy | 40/603 |
| 4,317,302 | 3/1982 | Van DeLinde | 40/603 |

FOREIGN PATENT DOCUMENTS

| | | | |
|---|---|---|---|
| 18991 | 11/1889 | United Kingdom | 40/603 |

*Primary Examiner*—Gene Mancene
*Assistant Examiner*—Wenceslao J. Contreras
*Attorney, Agent, or Firm*—Dorsey & Whitney

[57] ABSTRACT

A sign structure of the type having a pluality of elongated sign frame elements defining a sign frame and a facing material covering at least one face of the sign frame. The improvement relates to an improved sign frame structure, an improved facing material gripping mechanism and an improved facing material tensioning device.

12 Claims, 12 Drawing Figures

SIGN FRAME

The present invention relates generally to a sign structure and more particularly to an improved sign frame construction having improved means for gripping the sign facing material and an improved means for tensioning the facing material.

BACKGROUND OF THE INVENTION

Most generally large scale signs currently in existence include a sign frame structure, a sheet or facing material covering the frame construction for displaying the contents of the sign, a means for gripping the sheet or facing material at its edges and means for tensioning the facing material across the framing structure. In many prior art devices, the sheet or facing material is looped around a flat metal bar and sewn or otherwise secured so that a retaining or tensioning force applied to the metal bar will in turn retain or tension the facing material. The respective edges of the facing material are then either retained in a fixed position with respect to the sign frame structure by various types of securing members or are connected with a tensioning mechanism for tensioning or stretching the facing material across the sign frame structure. Various means for accomplishing this tensioning exist in the prior art. Most of these include threaded members of some sort having one end connected to the facing material gripping means with the other end secured to a portion of the sign frame. The facing material is then tensioned or stretched by approprately rotating a portion of the threaded member. An example of one such threaded member used as a tensioning means is shown in U.S. Pat. No. 3,934,365.

SUMMARY OF THE INVENTION

The present invention relates to a sign structure having an improved frame structure, an improved facing material gripping means for gripping the facing material abouts its peripheral edges and an improved means for tensioning or stretching the facing material.

More specifically, the facing material gripping means includes looping the edge of the facing material around a relatively small polyethylene tube material and then inserting the same within an elongated retaining tubular member extending the length of the facing edge to be gripped. The preferred construction consists of an elongated tubular member having a slot along one side which extends the entire length of the tube. In operation, the polyethylene tube is retained within the tubular shaped element with the facing material extending through the elongated slot. The other end of the retaining tube includes a connecting flange or portion for connection with the tensioning means.

The improved tensioning or stretching means of the present invention includes a plurality of ratchet members secured in spaced relationship along at least two adjacent sides of the sign frame. Each of these ratchet members includes a piece of strap material extending to a connecting hook which is adapted to connect with the connecting flange of the gripping means. As the ratchet member is operated so as to retract the connecting hook, the entire gripping means is moved as well, thus stretching or tensioning the sign facing material. In an alternate embodiment of the present invention, a spring member is provided between the connecting flange and the connecting hook to accommodate expansion and contraction of the entire sign frame construction due to ambient temperature changes. This embodiment is particularly useful when paper facing material is used since the paper material is generally inflexible and is therefore incapable of withstanding dimensional changes which might occur because of such contraction or expansion.

The improved frame structure includes a generally flat metal web portion having a first lip or flange portion integrally formed with one longitudinal edge of the web portion and extending inwardly toward the center portion of the sign frame. This flange portion is then doubled back on itself for added strength. The other longitudinal edge of the web portion includes a second lip or flange portion extending in a direction away from the center portion of the sign frame. The outer edge of this lip or flange is also doubled back on itself for added strength. Both of the first and second flanges are perpendicular to the flat web portion and parallel to the sign facing material, however, both extend from the flat web section in opposite directions. This particular frame structure facilitates the direct mounting of the end shrouds to this second flange for housing the tensioning means and for providing a finished appearance to the sign frame.

Accordingly, it is an object of the present invention to provide an improved sign frame construction having an improved means for gripping the peripheral edges of the facing material.

Another object of the present invention is to provide an improved tensioning means for stretching or tensioning the facing material.

A further object of the present invention is to provide an improved sign frame structure which facilitates the direct connection of the end shroud.

These and other objects of the present invention will become apparent with reference to the drawings, the description of the preferred embodiment, and the appended claims.

DESCRIPTION OF THE PREFERRED EMBODIMENT

Figure 1:
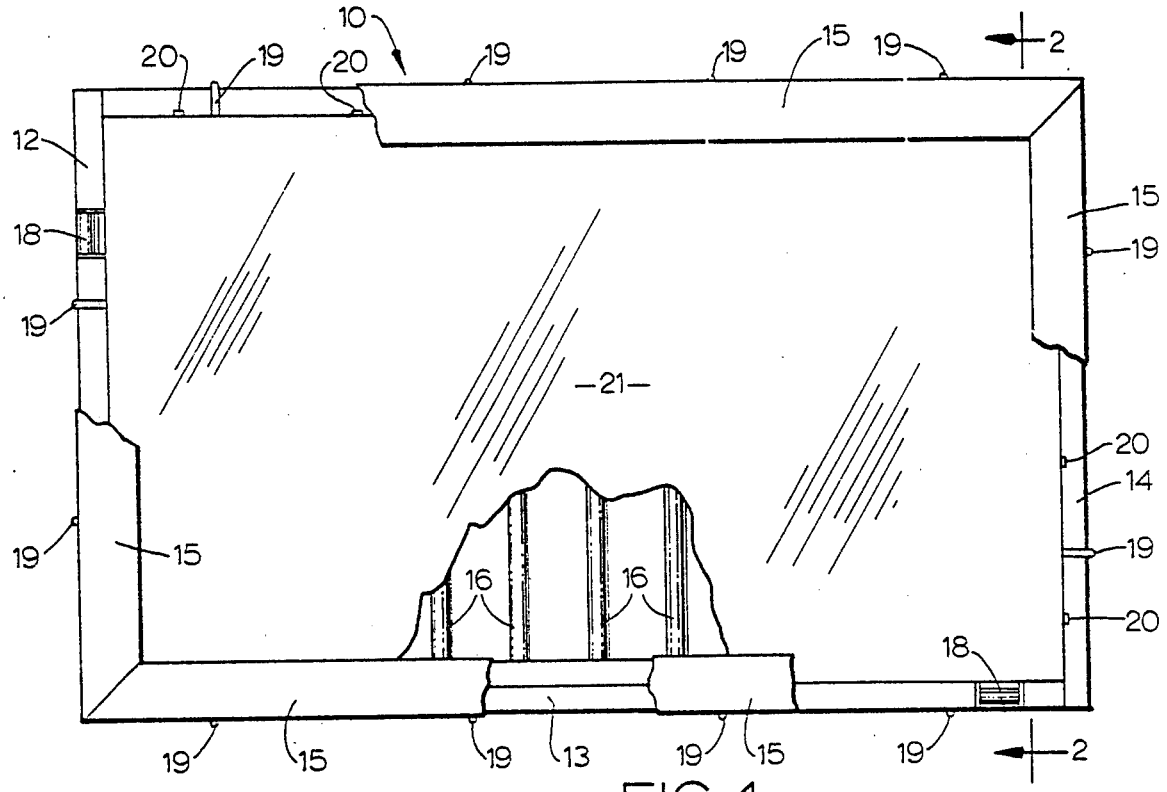
FIG. 1 is an elevational view, with sections partly broken away, showing a front view of a sign frame construction incorporating the features of the present invention.

Reference is first made to FIG. 1 showing a sign structure embodying the sign frame and the facing material gripping and tensioning means of the present invention. Portions of the sign are broken away to better illustrate the sign construction. The sign is generally illustrated by the reference numeral 10 and includes the sign frame elements 11, 12, 13 and 14 which define the peripheral supporting structure of the sign. Each of the sign frame elements 11–14 is joined together at its ends to an adjacent sign frame element by a welded joint. The specific construction of these frame elements will be described in greater detail below.

The sign also includes a sign facing material 21 having a shape and size sufficient to cover the entire face of the sign. The facing material is gripped and retained at its peripheral edges by facing material gripping means such as those illustrated in FIGS. 5, 6, 7 and 11. These will be described in greater detail below. Means are also provided on two adjacent edges in the form of a plurality of pin members 20 for retaining two of the facing material edges with respect to the frame members 11 and 14. The other two sides of the frame include facing material tensioning means in the form of a plurality of ratchet members 18 for tensioning the facing material 21. A shroud 15 is connected with a portion of the frame members 11–14 to cover the tensioning ratchets 18 and to extend over a portion of the facing material 21 as a trim piece. As will be described in greater detail below, the shroud 15 is retained in part by a plurality of support members 19. A plurality of lights 16 are disposed internally within the sign to provide illumination for the facing material 21.

Figure 2:
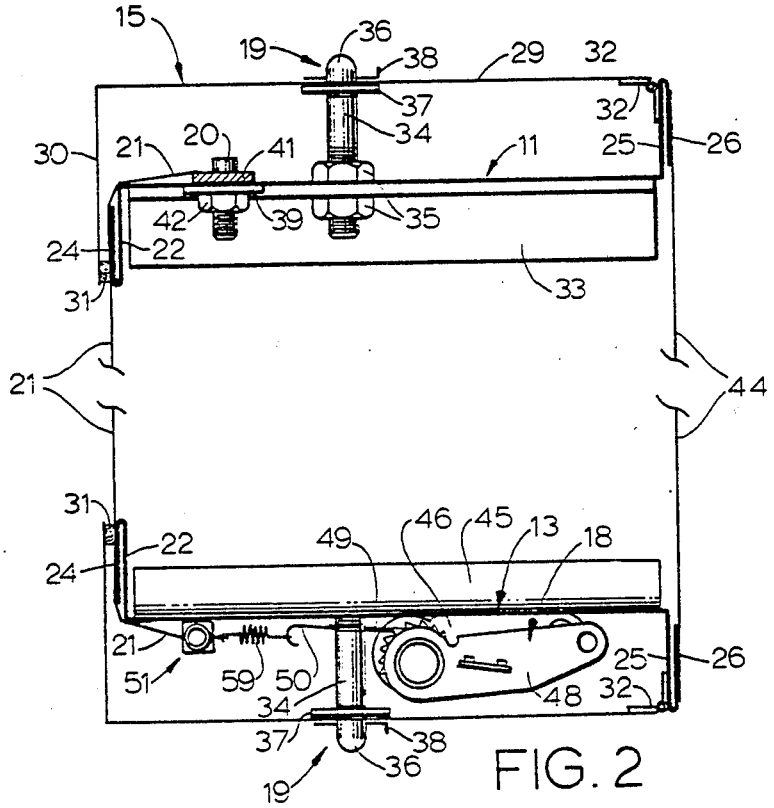
FIG. 2 is a contracted view, partially in section, as viewed along the section line 2—2 of FIG. 1.
Figure 3:
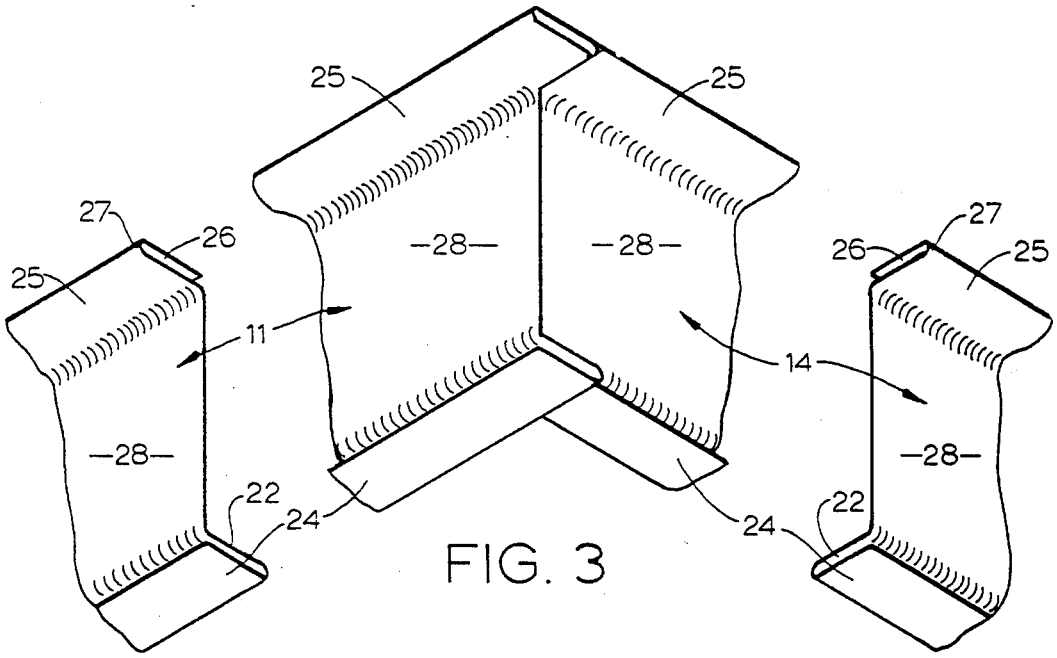
FIG. 3 is a pictorial view of a corner showing the structure of the sign frame of the present invention.
Figure 4:
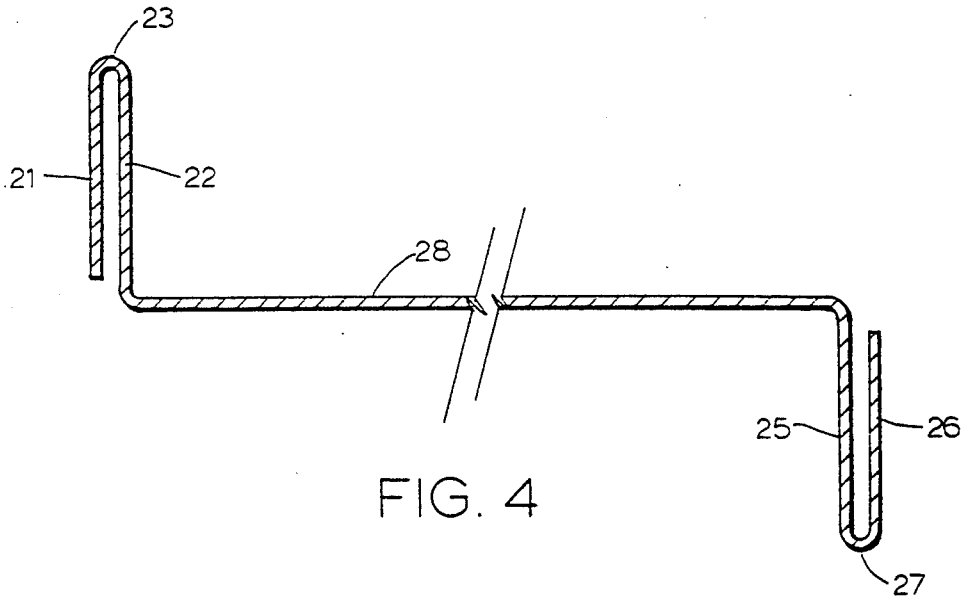
FIG. 4 is a cross-sectional view of the sign frame structure of the present invention.

Reference is next made to FIGS. 2, 3 and 4 showing the construction of the sign frame members 11–14 (FIG. 1). Although only two of these frame members are shown in FIGS. 2 and 3 and only one in FIG. 4, the constructional details of each of the four frame members are identical. As illustrated, each of the sign frame members 11–14 (FIG. 1) includes a generally flat base or web portion 28 which extends about the peripheral edge of the sign and is disposed at right angles with respect to the facing material 21 of the sign. Each of the frame elements 11–14 also includes a first or inwardly extending leg or flange portion comprising the leg members 22 and 24. The leg member 22 is integrally formed with one of the longitudinal edges of the base 28 and is bent at right angles with respect thereto. As shown best in FIGS. 2 and 3, the leg 22 extends inwardly from the base 28 in a direction parallel to the sign facing 21 and toward the center of the sign structure. The frame material is then bent back on itself to form a rounded edge 23 and a second leg member 24 adjacent and parallel to the leg member 22.

A second leg or flange member extends outwardly from the outer longitudinal edge of the base 28. This second flange includes a leg member 25 integrally joined with the base 28 and extending outwardly therefrom at right angles. The material forming the leg 25 is then bent back upon itself to form the rounded edge 27 and a second leg member 26 adjacent and parallel to the leg 25. Both of the leg members 25 and 26 are disposed in a generally parallel relationship with respect to the sign facing material 21 (FIGS. 1 and 2) and both extend from the base 28 in a direction opposite that of the leg members 22 and 24. Adjacent sign frame elements are joined together at the corners of the sign by notching one of the ends and welding the same together in the manner illustrated in FIG. 3. Although the sign frame members 11–14 (FIG. 1) and their associated subelements can be constructed of a variety of materials, the preferred embodiment contemplates that such elements will by constructed of a steel material such as 18 gauge steel.

With reference to FIGS. 1 and 2, the outer shroud or housing 15 consists of four individual edge pieces. Each of these pieces is connected along one of its longitudinal edges with the outer end of the leg member 25 of one of the frame elements 11–14 (FIG. 1) by a hinge 32. The legs of the hinge 32 are connected in a conventional manner to a longitudinal edge of the shroud 15 and the outer edge of the leg 25 to facilitate the pivoting of the shroud 15 with respect to the leg 25. As shown best in FIG. 2, each of the shroud or housing pieces includes an elongated flat portion 29 extending along an entire edge of the sign frame and having one longitudinal edge connected with the hinges 32. The other longitudinal edge of the flat portion 29 is bent at right angles to form a front or trim portion which, when in operative position, extends inwardly toward the center of the sign in a direction generally parallel to the facing material 21. The innermost edge of the trim portion 30 includes a piece of weather stripping material 31 secured to its inner edge and adapted to engage the outer surface of the facing 21.

Figure 9:
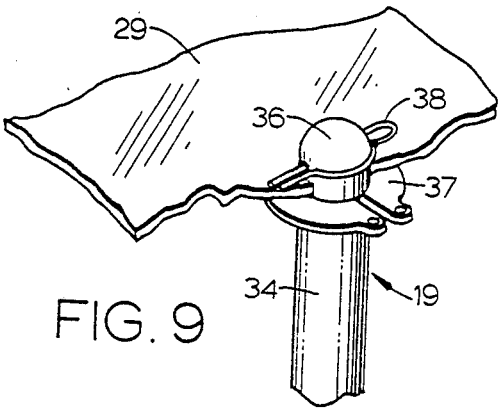
FIG. 9 is a pictorial view showing the means for retaining the shroud with respect to the shroud support pin.

The outer shroud 15 is retained in its operative position by a plurality of support pins 19 positioned about the periphery of the sign. Each of the support pins 19 includes a pin portion 34 extending through the flat portion 28 of each sign frame member (11–14) and each is secured to the sign frame member by a pair of threaded nuts 35, 35. In the preferred embodiment, a reinforcement cross-brace 33 (FIG. 2) is welded to the inner surface of the flat portion 28 to provide additional support for the pin portion 34. The pin portion 34 extends outwardly from the flat portion 28 and terminates in a top connecting end 36. As shown best in FIG. 9, the connecting end 36 extends through an opening in the outer shroud and includes a laterally extending hole to accommodate a hairpin member 38. The pin portion 34 includes a groove to support an internal spring washer 37 to support the flat portion 29 of the shroud 15.

In the preferred embodiment, the back of the sign is covered by a sheeting material 44 such as 18 gauge steel.

Figure 10:
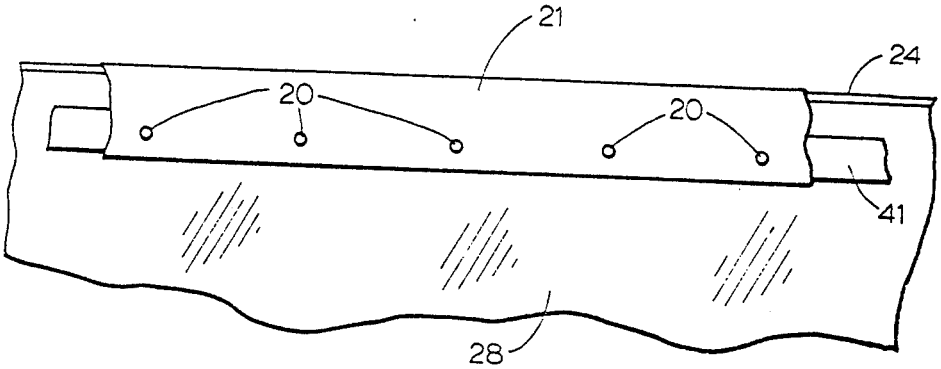
FIG. 10 is a top elevational view showing the means for retaining an edge of the facing material fixed with respect to the sign frame.

As illustrated best in FIGS. 2 and 10, on two adjacent edges, the facing material 21 extends over a rounded edge of the frame members adjacent to the legs 24 and 22 and is then wrapped around an edge retaining bar 41 and seamed. In the preferred embodiment, the bar 41 is a metal bar approximately ¼ inch thick and 2 inches wide and extending the entire length of the sign frame edge with which it is associated. The metal bar 41, as well as the facing material 21 which is looped around it, includes a plurality of holes to facilitate placing the bar 41 over the plurality of pin members 20 extending inwardly from the frame members 11–14 (FIG. 1). As shown in FIG. 2, each of the pin members 20 is connected with the flat portion 28 of the frame members via a threaded nut 42. In the preferred embodiment, the nut 42 is welded to the bottom of a reinforcement plate 39 which in turn is connected to the portion 28 and the pin 20 is then threaded into the nut.

Figure 12:
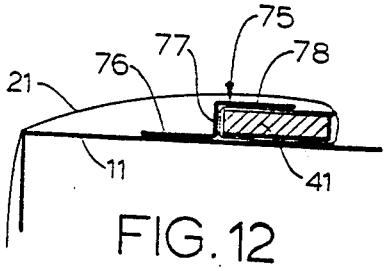
FIG. 12 is a view, partially in section, showing an alternate embodiment of a means for gripping the facing material.

An alternate embodiment to the bar 41 and pin 20 arrangement of FIGS. 2 and 10 is illustrated in FIG. 12. This embodiment includes a generally z-shaped bracket 75 having a first leg 76 welded to the frame member 11, a second leg 77 extending at right angles with respect to the member 11 and a third leg 78 extending parallel to the member 11 and spaced from it. This structure forms a pocket or groove into which the bar 41 is inserted and retained.

Figure 5:
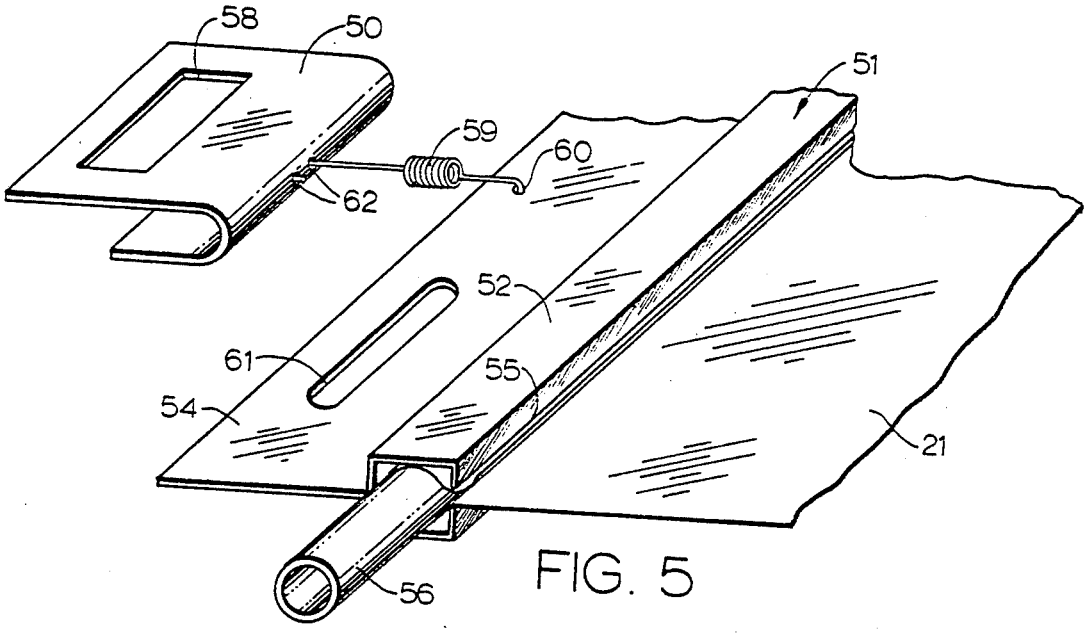
FIG. 5 is a pictorial view showing the improved means for gripping the facing material.
Figure 8:
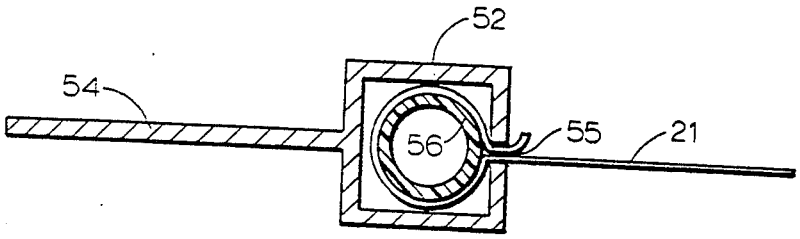
FIG. 8 is a cross-sectional view of the gripping means illustrated in FIG. 5.

With reference again to FIG. 2, the edges of the facing material opposite those connected with the bar 41 also extend over a rounded edge of the frame member with which such edge is associated. These edges of the facing material 21 are then gripped by a facing material gripping means illustrated generally in FIG. 2 by the reference numeral 51 and more specifically in FIGS. 5 and 8. With reference to FIGS. 5 and 8, the facing material gripping means includes an elongated hollow metal tubular structure 52 extending the entire length of the facing material edge. The member 52 includes a thin slot 55 extending its entire length and a rearwardly disposed connecting bracket or flange 54 for connection with the facing material tensioning means. The connecting flange is disposed on the opposite side of the member 52 as the slot 55. The gripping means also includes a generally cylindrical tubular member 56 around which the facing material 21 is looped. As illustrated, the facing material 21 is inserted through the slot 55 around the tubular member 56 and back out through the slot 55. In the preferred embodiment, the tubular member 56 is constructed of a polyethylene material which is relatively soft. With the tube 56 constructed of this material, tensioning force on the facing material 21 causes the tube 56 and the two layers of facing material 21 to become wedged into the slot 55. This wedging retains the facing material 21 with respect to the elongated member 52 and dispenses with the need for seaming the facing material 21 into a loop or otherwise connecting it to the gripping means.

The operation of this gripping means involves first looping the facing material edge around the tube 56 and then inserting the tube 56 and facing material into the end of the element 52 from its end with the two layers of facing material extending through the slot 55. In the preferred embodiment, the slot is approximately $\frac{1}{8}$ inch wide with the facing material being about 1/32 inch thick. Thus, the slot width is about four times the thickness of the facing material.

As also illustrated in FIG. 5, a connecting means in the form of the hook shaped bracket 50 is adapted to be connected with the connecting flange 54. In FIG. 5, the bracket 50 and flange 54 are shown as connected via an intermediate spring member 59 having one end connected to the hole 60 in the flange 54 and the other end connected to the hole 62 in the bracket 50. The purpose of the spring 59 in such connection is to accommodate expansion and contraction in the frame members due to varying ambient weather conditions. This is particularly important when the facing material 21 is constructed of a relatively inflexible material such as paper. If the facing material 21 is constructed of a synthetic material such as polyethylene, it has some flexibility; thus, the bracket 50 can be connected directly to the connecting flange 54 by inserting the bracket 50 through the elongated opening 61 in the flange 54.

Figure 6:
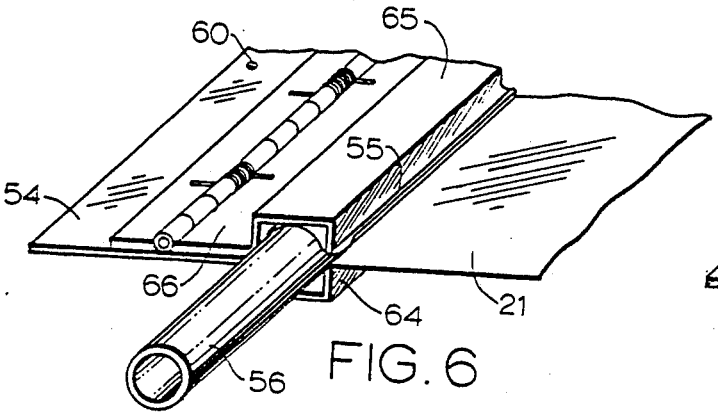
FIG. 6 is an alternate embodiment of the improved means for gripping the facing material.

FIG. 6 shows an alternate embodiment of a facing material gripping means. As illustrated, the primary difference between the structure in FIG. 6 and the structure in FIG. 5 is that the elongated tubular member in FIG. 6 is comprised of two elongated portions 64 and 65 which are joined together by a spring loaded hinge element 66. An advantage of this embodiment is that in order to insert the tube 56 and the facing material 21 within the elongated members 64 and 65, the member 65 is simply pivoted upwardly about the hinge 66. The entire length of the tube 56 with the facing material 21 looped about it is then inserted into the portion 64. The member 65 is then allowed to pivot into a closed operating position as illustrated in FIG. 6. This eliminates the necessity of inserting the tube 56 and facing material from the end as in the embodiment of FIG. 5. Because the hinge 66 is spring loaded, the resulting structure functions similar to that of FIG. 5 with the tensioning force being sufficient to hold the tube 56 and the facing material layers wedged in the slot 55.

Figure 7:
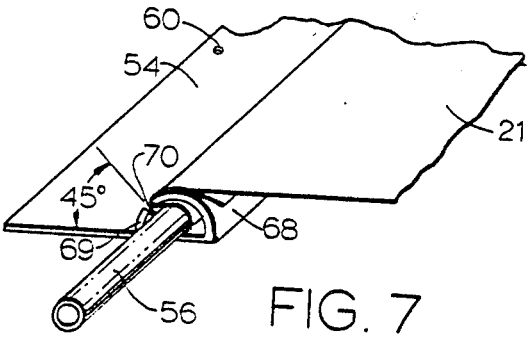
FIG. 7 is a further alternate embodiment of the means for gripping the facing material.

A further embodiment of the material gripping means is illustrated in FIG. 7. This embodiment discloses a curved portion 68 extending in a curved manner toward the rearward connecting flange 54 with the elongated slot 70 existing between the portion 68 and the portion 69. In this embodiment, the slot 70 is disposed toward the rear of the gripping element. This structure contemplates the introduction of the tubular member 56 with the facing material 21 wrapped about it in the same manner as the embodiment of FIG. 5. This particular embodiment has the advantage of holding the facing material 21 tighter, although it is somewhat more difficult to assemble. As illustrated, the slot in the embodiment of FIG. 7 is disposed approximately 45° from the flange 54.

Figure 11:
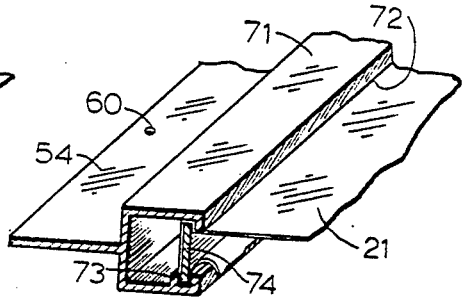
FIG. 11 is a pictorial view showing a further alternate embodiment of the means for gripping the facing material.

FIG. 11 illustrates a still further embodiment of the means for gripping the peripheral edge of the facing material. As shown, this embodiment includes an elongated tubular member 71 having a relatively wide slot 72 in one side of the member 71 and extending in a direction parallel to the elongated axis of the member 71. A relatively stiff bar 74 of rectangular cross-section is positioned within the member 71 as illustrated. The width dimension of the bar 74 is slightly less than the internal dimension of the member 71 to allow the facing material 21 to extend around the bar 74. One side of the member 71 includes a rib or flange 73 to define a groove into which one edge of the bar 74 is disposed. This groove retains the bar 74 and prevents movement of the bar 74 when the facing material 21 is tensioned. As shown, the width of the groove defined by the flange 73 is slightly wider than the thickness of the bar 74. A connecting flange 54 with a hole 60 therein is connected with the side of the member 71 opposite the slot 72. The advantage of this particular embodiment is to permit the bar 74 with the facing material 21 wrapped aound to be inserted from the side rather than from the end as is necessary in the embodiments of FIGS. 5 and 7. To facilitate this, the slot 72 must be wider than the thickness of the bar 72.

Reference is again made to FIG. 2 which shows the means 18 for tensioning the facing material 21. In the preferred embodiment, this means 18 comprises a plurality of ratchet members connected with the frame members and disposed on at least two adjacent sides of the sign frame. As shown in FIG. 2, the ratchet member includes a base portion 46 which is securely connected with the outer surface of the flat portion 28 of one of the frame members. In the preferred embodiment, the connection is made by a plurality of threaded members (not shown). A generally "U" shaped flange or raceway 45 is secured to the inner surface of the frame member to which the base 46 is connected to reinforce and add additional support to the frame member in the area where the ratchet is connected. The ratchet means also includes a handle portion 48 for pivotal movement to tighten a nylon belt or strap 49 about an internal roller. As shown in FIGS. 2 and 5, the nylon strap 49 is connected to the connecting bracket 50 via the opening 58. Although a number of different ratchets will function satisfactorily, the ratchet member 18 of the preferred embodiment is similar to that illustrated in U.S. Patent No. 4,185,360. In the preferred embodiment it is contemplated that the ratchet members 18 should be disposed approximately every six feet along two adjacent edges of the sign frame.

Although the description of the preferred embodiment has been quite specific, it is contemplated that various changes could be made without deviating from the spirit of the present invention. Accordingly, it is contemplated that the scope of the present invention be dictated by the appended claims rather than by the description of the preferred embodiment.

I claim:

1. A sign structure comprising:

a plurality of elongated sign frame elements each joined at its ends to an adjacent sign frame element to define a sign frame having a closed center portion;

a facing material having an edge corresponding to each edge of said sign frame and having a shape and size sufficient to cover one face of said sign frame;

a facing material gripping means associated with each edge of said facing material for gripping said facing material;

connection means for connecting each of said facing material gripping means to a corresponding sign frame element; and wherein each of said sign frame elements includes an elongated, generally flat base having a pair of generally parallel longitudinal edges and being disposed at right angles with respect to said facing material, a first flange portion integrally formed with one of the longitudinal edges of said base and extending inwardly toward said center portion of said sign structure at right angles to and inwardly of the innermost portion of said base and a second flange portion integrally formed with the other of the longitudinal edges of said base and extending outwardly from said center portion of said sign structure in a direction opposite said first flange portion and at right angles to and outwardly of the outermost portion of said base.

2. The sign structure of claim 1 wherein each of said first and second flange portions includes first and second leg members adjacent and parallel to one another.

3. The sign structure of claim 2 wherein said first leg member of each of said first and second flange portions is integrally connected with said base and said second leg member is integrally connected with its corresponding first leg member.

4. The sign structure of claim 1 wherein said connection means includes facing material tensioning means on at least two adjacent sign frame elements.

5. The sign structure of claim 4 wherein said facing material tensioning means includes a plurality of ratchet members connected to the base of said sign frame elements.

6. The sign structure of claim 1 wherein said facing material gripping means associated with at least one edge of said facing material includes an elongated tubular element extending substantially the entire length of said one edge, an elongated slot extending longitudinally along said tubular member and a generally cylindrical tube of smaller diameter than the internal dimension of said tubular member, said tube adapted for insertion within said tubular member with said facing material looped around it.

7. The sign structure of claim 1 including an elongated shroud element associated with each of said sign frame elements, each of said shroud elements including a first longitudinal edge pivotally secured to said second leg of its associated sign frame element and a second longitudinal edge extending over an edge portion of said facing material.

8. The sign structure of claim 1 wherein said facing material gripping means associated with at least one edge of said facing material includes an elongated bar having an elongated cross-sectional configuration, said one edge of said facing material extending around said bar and secured to a portion of said facing material to form a loop, and an elongated retaining bracket having a first leg secured to one of said sign frame elements, a second leg integrally formed with and extending from said first leg at right angles and a third leg integrally formed with said second leg and extending in spaced relationship and parallel to said one sign frame member to form a pocket to receive said bar.

9. The sign structure of claim 7 including a plurality of shroud supporting posts mounted on and extending outwardly at spaced intervals along each of said bases.

10. The sign structure of claim 9 including means for connecting said shroud elements to said shroud supporting posts.

11. The sign structure of claim 1 wherein each base is comprised of a single sheet of metal.

12. The sign structure of claim 7 wherein said portion of said shroud element extending over an edge portion of said facing material is provided with a strip of weather stripping material.

* * * * *